US008047305B2

(12) United States Patent
Dye et al.

(10) Patent No.: US 8,047,305 B2
(45) **Date of Patent: *Nov. 1, 2011**

(54) VACUUM FEED SUPPLY SYSTEM FOR DRILLING FLUID ADDITIVES

(75) Inventors: William M. Dye, Cypress, TX (US); Nels A. Hansen, Spring, TX (US); John B. Trenery, Jr., Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/777,891

(22) Filed: May 11, 2010

(65) Prior Publication Data

US 2010/0243329 A1 Sep. 30, 2010

Related U.S. Application Data

(62) Division of application No. 12/026,318, filed on Feb. 5, 2008, now Pat. No. 7,712,551.

(51) Int. Cl.
*C09K 8/02* (2006.01)

(52) U.S. Cl. ..... 175/65; 175/206; 175/207; 175/66; 175/68; 175/69

(58) Field of Classification Search ..... 175/206, 175/207, 66, 69, 68, 72
See application file for complete search history.

(56) References Cited

U.S. PATENT DOCUMENTS

| | | | |
|---|---|---|---|
| 3,130,798 | A | 4/1964 | Schramm et al. |
| 3,534,822 | A | 10/1970 | Campbell et al. |
| 5,927,907 | A | 7/1999 | Shiraishi |
| 6,176,323 | B1 | 1/2001 | Weirich et al. |
| 6,467,340 | B1 | 10/2002 | Gallagher et al. |
| 7,256,159 | B2 | 8/2007 | Guichard et al. |
| 7,389,787 | B2 | 6/2008 | Means et al. |
| 2008/0093125 | A1 | 4/2008 | Potter et al. |

OTHER PUBLICATIONS www.answers.com/topic/eductor-jet-pump.*
Bland, et al., :Overcome extreme conditions in HP.HT wells, http://www.epmad.com/archives/features/695.htm, CO2 Conference, Dec. 8-10, 2008, 3 pp., Houston, Texas.
Bland et al., "Drilling Fluid Meets Deep Gas Drilling Challenges", Oil Online Asian Oil and Gas Event, May/Jun. 2005.
Bland et al., "Balling in Water-Based Muds", ADE 01-NC-HO-56, National Drilling Technical Conference, Mar. 27-29, 2001, 14pp, Houston, Texas.
Stowe, et al., "Laboratory Pore Pressure Transmission Testing of Shale", AADE 01-NC-HO-44,National Drilling Technical Conference, Mar. 27-29, 2001, 10pp, Houston, Texas.

* cited by examiner

*Primary Examiner* — Jennifer H Gay
*Assistant Examiner* — Yong-Suk Ro
(74) *Attorney, Agent, or Firm* — Mossman, Kumar & Tyler, PC

(57) ABSTRACT

A system for forming a subterranean wellbore may include a pump and an additive supply. The pump pumps a drilling fluid into the wellbore while also generating a pressure differential that draws an additive across a supply line connected to the additive supply. The drilling fluid may be a gas or a liquid. A method for forming a wellbore may include drilling the wellbore, circulating a drilling fluid in the wellbore using a pump; and supplying an additive to the drilling fluid by flowing the additive across a supply line using a pressure differential generated by the pump. The pump may generate a vacuum pressure at a supply line outlet and/or create a pressure differential in the supply line. The flow of additive across the supply line may be regulated and/or stopped when the pump is not operating.

9 Claims, 2 Drawing Sheets

VACUUM FEED SUPPLY SYSTEM FOR DRILLING FLUID ADDITIVES

CROSS-REFERENCE TO RELATED APPLICATIONS

This application is a divisional of U.S. patent application Ser. No. 12/026,318, filed Feb. 5, 2008.

BACKGROUND OF THE DISCLOSURE

1. Field of the Disclosure

This disclosure relates generally to additive supply systems for oilfield downhole tools.

2. Description of the Related Art

To obtain hydrocarbons such as oil and gas, boreholes or wellbores are drilled by rotating a drill bit attached to the bottom of a drill string. During drilling, a drilling fluid is supplied under pressure into the drill string. The drilling fluid passes through the drilling assembly and then discharges at the drill bit bottom. The drilling fluid provides lubrication to the drill bit and carries the cuttings of rock and earth produced by the drill bit in drilling the wellbore to the surface. Typically, the costs associated with drilling the wellbore can be substantial. Thus, operators may utilize measures to enhance aspects such as the quality of the wellbore drilled, the reduction in wear and tear on drilling equipment, and time required to drill the wellbore. Some such measures involve the use of additives that control or vary one or more aspects of the downhole environment. These additives may be conveyed into the wellbore along with the drilling fluid.

The present disclosure addresses the need for methods and devices for introducing such additives into the drilling fluid, as well as other needs of the prior art.

SUMMARY OF THE DISCLOSURE

In aspects, the present disclosure provides a system for forming a wellbore in an earthen formation. In one embodiment, the system may include a reservoir of water-based drilling fluid, an additive source, and a pump. The pump may have a suction line having an inlet positioned at the reservoir and proximate to an outlet of a supply line receiving the additive from the additive source. The pump may be configured to reduce pressure at the suction line inlet to cause the additive to flow through the supply line. In some arrangements, the supply line may be physically separated from the suction line. The supply line outlet may also be positioned inside the suction line inlet. Further, a flow regulating device may be used to meter or control the flow of additive across the supply line. In embodiments, the additive may have a density that is lower or higher than the density of the water-based drilling fluid. Additionally, because the vacuum pressure of the pump is being used to draw fluid across the supply line, the supply line may be configured to have substantially no flow of additive when the pump is not operating.

In embodiments, the system may include a pump and an additive supply having an additive to be added to a drilling fluid. The pump may be configured to generate a pressure differential that flows the additive across a supply line connected to the additive supply while also pumping the drilling fluid into the wellbore. In embodiments, the drilling fluid may be a gas or a liquid.

In another aspect, the present disclosure provides a method for forming a wellbore in an earthen formation. In embodiments, the method may include drilling the wellbore, circulating a drilling fluid in the wellbore using a pump; and supplying an additive to the drilling fluid by flowing the additive across a supply line using a pressure differential generated by the pump. In one arrangement, the method may include generating a vacuum pressure at a supply line outlet using the pump; and/or operating the pump to create a pressure differential in the supply line that causes the additive to flow across the supply line. In arrangements, the method may further include regulating a flow of additive across the supply line. In embodiments, the method may also include configuring the supply line to substantially cease flow of the additive when the pump is not operating.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
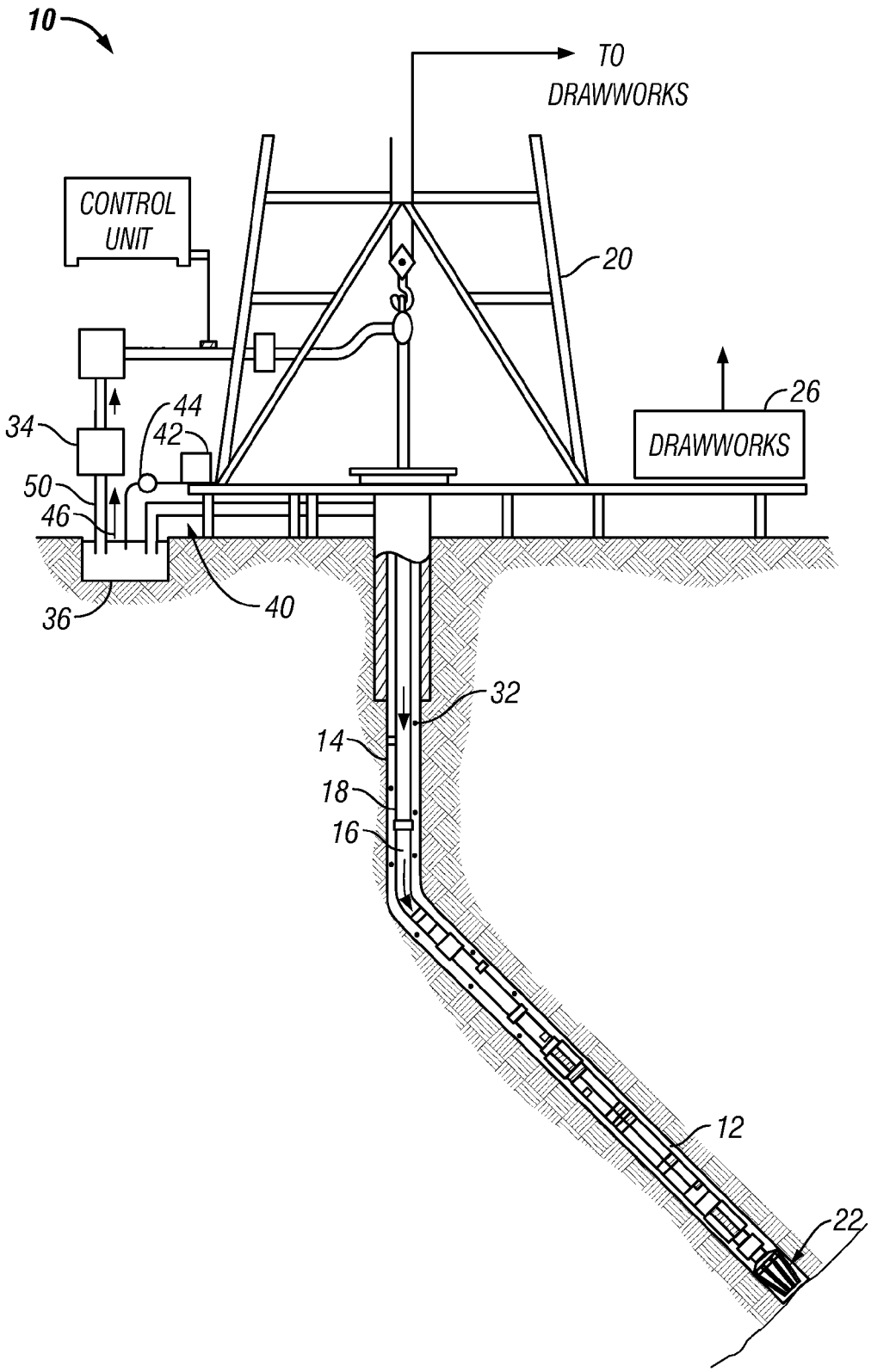
FIG. 1 illustrates an exemplary drilling system made in accordance with one embodiment of the present disclosure.

The present disclosure relates to devices and methods for enhancing the effectiveness of the drilling of wellbores. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring now to FIG. 1, there is shown an embodiment of a drilling system 10 made according to one embodiment of the present disclosure to drill wellbores. While a land-based rig is shown, these concepts and the methods are equally applicable to offshore drilling systems. The system 10 shown in FIG. 1 has a drilling assembly 12 conveyed in a borehole 14 via a drill string 16. The drill string 16 includes a tubular string 18, which may be drill pipe or coiled tubing, extending downward from a rig 20 into the borehole 14. A drill bit 22, attached to the drill string end, disintegrates the geological formations when it is rotated to drill the borehole 14. The drill string 16 may include power and/or data conductors such as wires for providing bi-directional communication and power transmission.

The system 10 also includes a drilling fluid circulation system 30 that circulates drilling fluid in a fluid circuit formed by a bore of the drill string 16 and an annulus 32 formed between the drill string 16 and the wall of the borehole. One or more mud pumps 34 at the surface draw the drilling fluid, or "drilling mud," from a mud pit 36 and pump the drilling mud into the bore hole 14 via the drill string 16. The drilling mud exits at the drill bit 22 and flows up the annulus 32 to the surface. The returning drilling fluid may be processed, cleaned and returned to the mud pit 36 or disposed of in a suitable manner. The circulating drilling mud serves a number of functions, including cooling and lubricating the drill bit 22, cleaning the borehole of cuttings and debris, and maintaining a suitable fluid pressure in the wellbore (e.g., an overbalanced or at-balanced condition).

In aspects of the present disclosure, the drilling fluid circulation system 30 is utilized to convey one or more fluids, other than drilling fluids, into the borehole 14. In one arrangement, the drilling fluid may be a water-based drilling mud as opposed to an oil-based drilling mud. Certain downhole environments may be considered water-wettable or hydrophilic. Thus, while water-based drilling mud may be more cost-effective, the debris may stick to tools and devices such as the drill bit, which may cause "balling" of the drill bit. Bit balling refers to a condition where rock, earth or other debris clogs the cutting elements of the drill bit and reduces the cutting effectiveness of the drill bit. Thus, a conveyed fluid may be an additive formulated to prevent debris and other material from sticking to downhole surfaces and thereby enhance drilling effectiveness. Such fluids are herein referred to as anti-balling agents.

Figure 2:
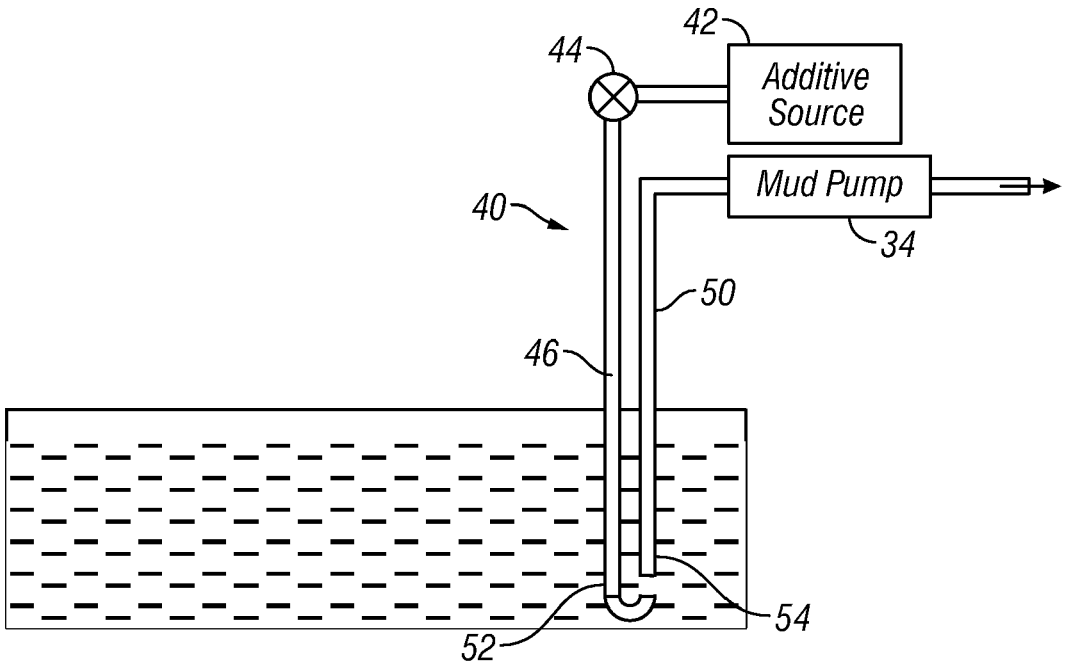
FIG. 2 schematically illustrates one additive supply system made in accordance with one embodiment of the present disclosure.

Referring now to FIG. 2, in one embodiment, an additive supply system 40 may be positioned at the surface to supply one or more additives during drilling. The additive supply system 40 is configured to supply an additive to the drilling fluid circulation system 30 in a manner that reduces the likelihood that the supplied additive becomes emulsified in the circulating drilling fluid. Emulsification generally tends to reduce the effectiveness of additives. In one arrangement, the additive supply system 40 includes a supply source 42, a flow metering device 44, and flow line 46. The shown elements of the fluid circulation system 30 are the mud pump 34, the mud tank 36 and a suction line 50. In a conventional manner, the mud pump 34 draws drilling mud from the mud tank 36 by reducing the pressure in the suction line 50. The reduced pressure in the suction line 50 creates a pressure differential that causes fluid to flow from the mud tank 36 and into the suction line 50. The additive supply system 40 is configured to utilize the reduced pressure in the suction line 50 to flow one or more additives from the supply source 42. In one embodiment, an exit 52 of the flow line 46 is positioned proximate to an inlet 54 of the suction line 50. For purposes of this disclosure, the term "proximate" means that a reduced pressure at the inlet 54 is sufficient to initiate and maintain a flow of additive out of the exit 52 of the flow line 46. Thus, the reduced pressure at the suction line inlet 54 creates a difference in pressure between the region of the flow line exit 42 and in the supply source 42 of sufficient magnitude to cause additive to flow out of the supply source 42, across the flow metering device 44 and through the flow line 46. As shown in FIG. 2, the flow line exit 52 is shown as positioned at or within the suction line inlet 54, but physically separate from the suction line inlet 54. However, this need not necessarily be the case. For example, the flow line exit 42 may be separated by a given distance from the suction line inlet 54. It will be understood that the distance can vary depending on the operating pressures the mud pump 34, the viscosity or other characteristics of the drilling fluid, the diameters of the various flow lines, etc.

Although a hydrostatic head may be available in the flow line 46, it should be appreciated that additives normally have a lower density than water-based drilling fluids or even oil-based drilling fluids. Thus, hydrostatic head alone will likely not provide the sufficient force to induce additive flow through the flow line 46. Thus, sustained additive flow through the flow line 46 may be established only upon activation of the pump 34 and the resulting pressure drop in the suction line 50. The pressure drop causes the pressure at the suction line inlet 54 to be lower than the pressure in the supply source 42. In one aspect, therefore, the additive supply system 40 automatically supplies additive when the pump 34 operates and stops the supply of additive when operation of the pump 34 is terminated. The terms "reduced" pressure, "negative" pressure and "vacuum" pressure shall be used interchangeably to denote the pressure condition at the suction line inlet 54 that is sufficient to induce additive flow in the flow line 46.

Further, by flowing the additive directly or nearly directly into the inlet 54 of the suction line 50, the additive is protected from being mixed with the rather large body of drilling mud in the mud tank 36 and spending a relatively long amount of time in the mud tank 36 prior to flowing down the drill string. Thus, the strategic positioning of the exit 52 to the inlet 54 maintains the additive in a relatively concentrated form and reduces the amount of time the additive spends in the drilling mud prior to flowing downhole. Furthermore, it should be appreciated that by directing the additive into the suction side of the pump 34, the system does not need to add energy to introduce the additive into the drill string. That is, if the additive were to be introduced along the discharge side of the pump 34, then an energy adding device such as a pump would be needed to pressurize the additive in order to inject the additive into the drill string. Thus, no energy-consuming device, such as a pump, is required in the described embodiment to flow the additive to the drill string.

In embodiments, the supply source 42 may be a container that is permanent or portable. In one arrangement, the source 42 may be an aluminum tank of a relatively small volume, e.g., ten gallons. It should be appreciated that a relatively small and lightweight tank may be easily positioned on the rig 10. Such a tank may be easily manually refilled or replaced. In other embodiments, the additive may be stored in larger tanks such as tote tanks or fifty-five gallon drums. The type of container used will depend, in part, on the availability of space on the rig and the quantity of additive to be added. The flow metering device 44 may be a flow control device such as a needle valve that can be adjusted to control the flow rate of additive from the source 42 to the flow line 46. In embodiments, the flow metering device 44 may be operatively coupled to a remote controller and operated remotely. In still other embodiments, the flow line 46 may be pressurized using a pump (not shown) or other device to assist the flow of additive in the flow line 46.

As noted previously, the additive should be supplied in a manner that minimizes the emulsion of the additive in the drilling fluid. Thus, the operating parameters of the additive supply system 30 are selected to allow additive to flow continuously out of the flow line exit 52 and into the suction line inlet 54. In many arrangements, the operating pressure of the mud pump 34 is selected to provide certain drilling operating characteristics and/or wellbore conditions. Thus, the configuration of the additive supply system 30 may be adjusted supply a substantially continuous additive stream in response to the available vacuum pressure in the suction line 50. Thus, for a predetermined pressure differential in the suction line 50, the additive supply system 30 may provide a substantially continuous flow of additive by controlling one or more of: (i) the distance separating the flow line exit 52 and into the suction line inlet 54; the flow rate across the flow metering device 44; the dimensions and configuration of the flow line 46 (e.g., length, diameter, shape, etc.); the size of the source 42, the positioning of the source 42 (e.g., elevation to provide a pressure head).

In illustrative variants to the present disclosure, the additive supply system 40 may be used in connection with drilling systems that do not use liquids as the drilling fluid. In certain drilling operations, a gas, such as air, may be used to cool and clean the drill bit and clear the drilled hole of cuttings. Those drilling environments also may be hydrophilic. Thus, embodiment of the present disclosure may be used to introduce additives, which may be a liquid or gas, into the fluid, which may also be a liquid or a gas, flowing to the drill bit.

In illustrative variants to the present disclosure, the additive supply system 40 may also be used to convey additives other than those formulated to reduce the negative effects of a hydrophilic environment. These additives may be used to reduce hydrate formation, corrosion, enhance wellbore stability by minimizing dehydration of shale, etc.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. A method for forming a wellbore in an earthen formation, comprising:

providing a reservoir of water-based drilling fluid;

supplying an additive from an additive source via a supply line having an outlet located within the reservoir; and positioning an inlet of a suction line at the reservoir and proximate to the supply line outlet positioned in the reservoir; and reducing a pressure at the suction line inlet to initiate and maintain a flow of the additive through the outlet of the supply line thereby creating a mixture of the drilling fluid and the additive; and supplying the mixture to a drilling assembly forming the wellbore.

2. The method according to claim 1, further comprising:

physically separating the supply line from the suction line; and drawing the water-based drilling fluid and the additive into the inlet of the suction line.

3. The method according to claim 1, further comprising positioning the supply line outlet inside the suction line inlet.

4. The method according to claim 1, further comprising controlling a flow across the supply line without controlling flow across the suction line.

5. The method according to claim 1, wherein the additive has a lower density than the water-based drilling fluid.

6. A method for forming a wellbore in an earthen formation, comprising:

supplying a drilling fluid;

supplying an additive to the drilling fluid via a supply line;

operating a pump to generate a pressure differential that initiates and maintains the flow of the additive across the supply line and to flow the drilling fluid into the wellbore, wherein the supply line has an outlet physically separated from a suction inlet for the pump; wherein the step of operating the pump further comprises drawing a mixture of the drilling fluid and the additive into the inlet of the suction line; and supplying the mixture to a drilling assembly forming the wellbore.

7. The method according to claim 6, further comprising controlling a flow across the supply line without controlling flow across the suction line.

8. The method according to claim 6, wherein the drilling fluid is a gas.

9. The method according to claim 6, wherein the additive has a greater density than the drilling fluid.

* * * * *